US010185268B2

(12) United States Patent
Kurosu

(10) Patent No.: US 10,185,268 B2
(45) Date of Patent: Jan. 22, 2019

(54) IMAGE FORMING APPARATUS AND INSPECTION METHOD FOR CLEANING BLADE

(71) Applicant: Konica Minolta, Inc., Chiyoda-ku Tokyo (JP)

(72) Inventor: Shigetaka Kurosu, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/915,678

(22) Filed: Mar. 8, 2018

(65) Prior Publication Data

US 2018/0259893 A1 Sep. 13, 2018

(30) Foreign Application Priority Data

Mar. 13, 2017 (JP) ..... 2017-047797

(51) Int. Cl.
*G03G 21/00* (2006.01)
*G03G 15/00* (2006.01)
*G03G 15/16* (2006.01)

(52) U.S. Cl.
CPC ..... *G03G 15/553* (2013.01); *G03G 15/161* (2013.01); *G03G 15/5016* (2013.01); *G03G 15/5041* (2013.01); *G03G 2215/1661* (2013.01)

(58) Field of Classification Search
USPC ... 399/9, 11, 34, 38, 71, 107, 110, 123, 343, 399/344, 350
See application file for complete search history.

(56) References Cited

U.S. PATENT DOCUMENTS 8,406,673 B2 * 3/2013 Rimai ..... G03G 15/0812 399/274
8,577,239 B2 * 11/2013 Nishisaka ..... G03G 15/161 399/71
8,855,521 B2 * 10/2014 Yamaki ..... G03G 15/161 399/101

FOREIGN PATENT DOCUMENTS

JP 2016122068 A 7/2016

* cited by examiner

*Primary Examiner* — Hoan Tran
(74) *Attorney, Agent, or Firm* — Cantor Colburn LLP

(57) ABSTRACT

An image forming apparatus includes: an image bearing member to which a toner is supplied; a cleaning blade that removes the toner supplied onto the image bearing member; a hardware processor that performs control such that a tonner pattern for cleaning blade inspection is formed on the image bearing member; and a detector for detecting a toner that has slipped through the cleaning blade after the toner pattern has been allowed to reach the cleaning blade. The hardware processor performs control such that a contact portion of the cleaning blade with the image bearing member becomes a state in which slipping of a toner readily occurs, and identifies a defective site in the contact portion on the basis of a detected result by the detector.

14 Claims, 11 Drawing Sheets

IMAGE FORMING APPARATUS AND INSPECTION METHOD FOR CLEANING BLADE

CROSS REFERENCE TO RELATED APPLICATIONS

The present invention claims priority under 35 U.S.C. § 119 to Japanese Patent Application No. 2017-47797, filed on Mar. 13, 2017, which is incorporated herein by reference in its entirety.

BACKGROUND

Technological Field

The present invention relates to an image forming apparatus and an inspection method for a cleaning blade.

Description of Related Art

Electrophotographic image forming apparatuses (copiers, printers, facsimile machines, multifunction printers thereof) that form toner images on sheets conventionally include cleaning blades for removing residual toner on image bearing members, such as photoconductor drums, intermediate transfer belts, and secondary transfer rollers.

Blades formed of elastic materials, such as rubber, have been widely employed as cleaning blades. A counter mode is common, in which edges of such blades are brought into contact with image bearing members so as to counter the rotation direction of the image bearing members (see Japanese Patent Application Laid-Open No. 2016-122068, for example). Such counter-mode cleaning blades have advantages of simple configurations, low costs, and high removal performance of toner.

When contact portions of cleaning blades with image bearing members deteriorate due to abrasion, normal cleaning of residual toner on image bearing members becomes impossible and streaks of toner stains, for example, arise on the image bearing members. Transfer of such stains to sheets results in a problem, i.e., the occurrence of image defects. For this reason, image forming apparatuses regularly supply toner bands (toner patterns) as lubricants to cleaning blades, thereby imparting lubricity to the cleaning blades.

Meanwhile, the abraded state of a cleaning blade varies depending on various factors, such as the environment and the usage, as well as the sliding distance. Accordingly, it is not easy to estimate the life of a cleaning blade. Image defects due to slipping of toner arise in some cases before such an estimated life is reached. Even a non-abraded cleaning blade also temporarily causes cleaning failure in some cases, such as when the cleaning blade locally holds an extraneous material, or when a rubber blade is stiffened by frictional force between the rubber blade and an image bearing member.

SUMMARY

An object of the present invention is to provide an image forming apparatus that can execute an operation for preventing the occurrence of image defects and achieving long-term use of a blade, and an inspection method for a cleaning blade.

To achieve at least one of the abovementioned objects, an image forming apparatus reflecting one aspect of the present invention includes:

an image bearing member to which a toner is supplied;

a cleaning blade that removes the toner supplied onto the image bearing member;

a hardware processor that performs control such that a tonner pattern for cleaning blade inspection is formed on the image bearing member; and a detector for detecting a toner that has slipped through the cleaning blade after the toner pattern has been allowed to reach the cleaning blade, in which the hardware processor performs control such that a contact portion of the cleaning blade with the image bearing member becomes a state in which slipping of a toner readily occurs, and identifies a defective site in the contact portion on the basis of a detected result by the detector.

An inspection method for a cleaning blade reflecting another aspect of the present invention is an inspection method for a cleaning blade of an image forming apparatus that includes an image bearing member to which a toner is supplied and a cleaning blade which removes the toner supplied onto the image bearing member, and that executes a process of supplying a toner pattern for cleaning blade inspection to the image bearing member. The inspection method includes:

causing a contact portion of the cleaning blade with the image bearing member to become a state in which slipping of a toner readily occurs;

detecting a slipped toner after the toner pattern has been allowed to reach the cleaning blade; and identifying a defective site in the contact portion on the basis of a detected result.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
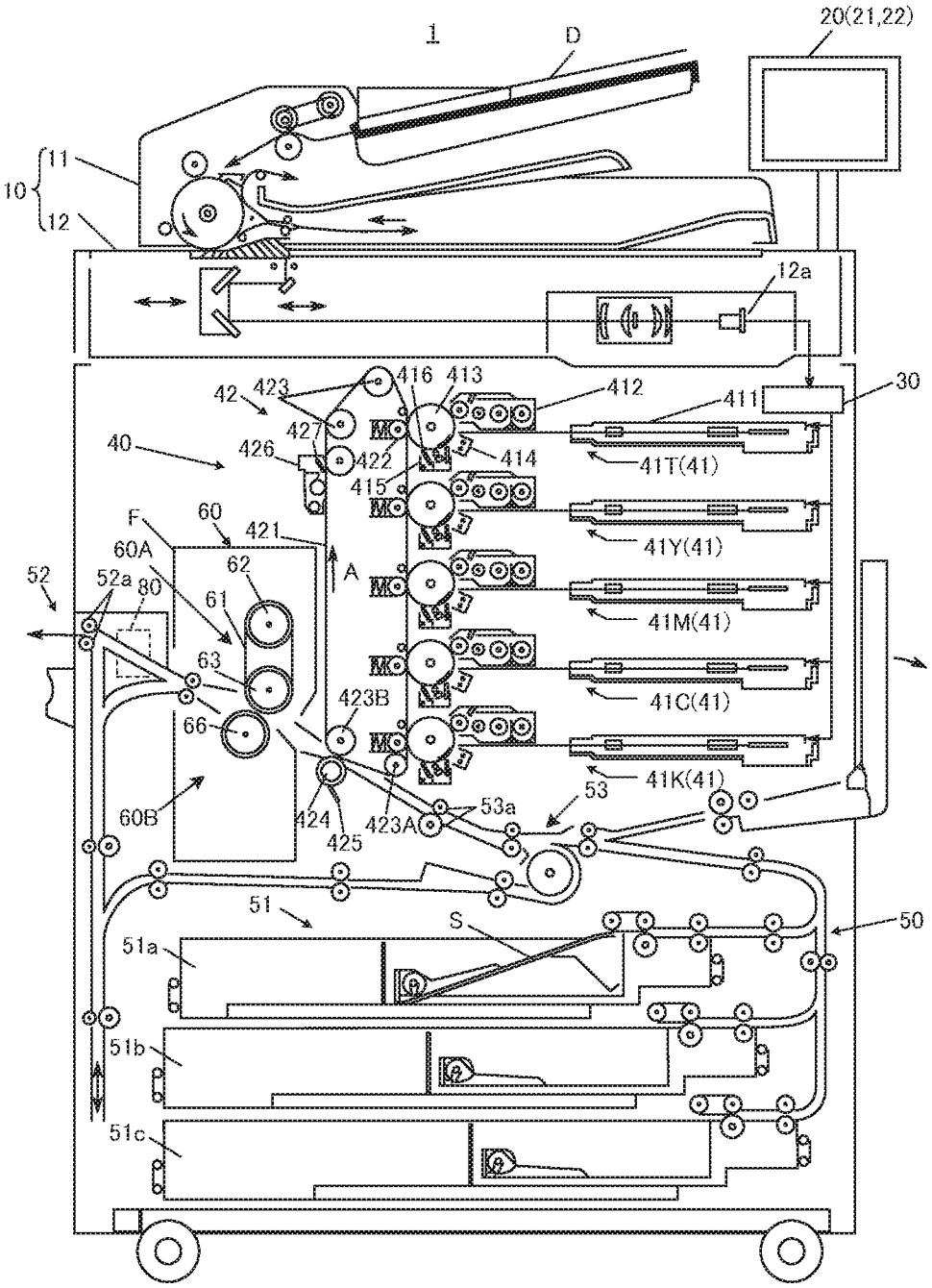
FIG. 1 schematically illustrates the entire configuration of an image forming apparatus of the embodiment.
Figure 2:
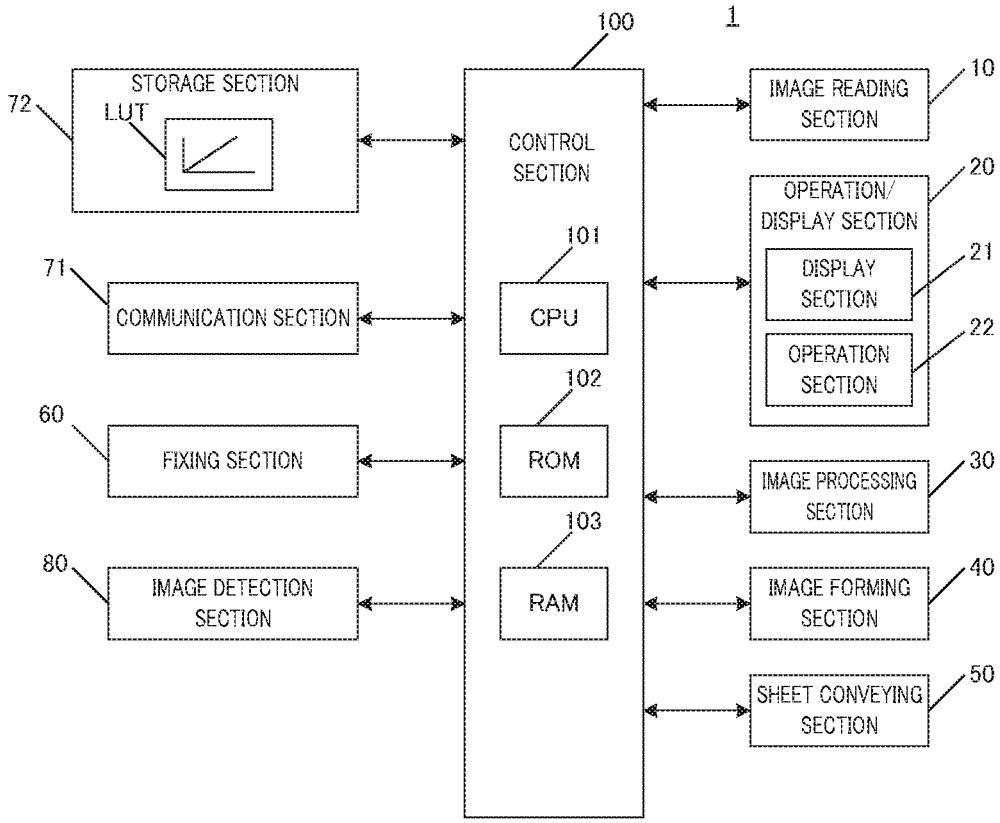
FIG. 2 shows the main part of a control system of the image forming apparatus of the embodiment.

FIG. 1 schematically illustrates the entire configuration of image forming apparatus 1 of the embodiment of the present invention. FIG. 2 shows the main part of a control system of image forming apparatus 1 of the embodiment. Image forming apparatus 1 illustrated in FIG. 1 and FIG. 2 are intermediate transfer-mode color image forming apparatus utilizing electrophotographic process technology. Image forming apparatus 1 transfers color toner images of transparent (T), yellow (Y), magenta (M), cyan (C), and black (K) formed on photoconductor drums 413 to intermediate transfer belt 421 to superimpose the five color toner images on intermediate transfer belt 421 (primary transfer), and then transfers the superimposed images to sheet S to form a toner image (secondary transfer).

Image forming apparatus 1 employs a tandem mode in which photoconductor drums 413 corresponding to TYMCK five colors are arranged in series in the running direction of intermediate transfer belt 421, and color toner images are successively transferred to intermediate transfer belt 421 in a single procedure.

In the embodiment, four color toners of yellow (Y), magenta (M), cyan (C), and black (K) are used to form toner images based on input image date (input image information) on sheet S via intermediate transfer belt 421. Meanwhile, transparent (T) toner is used to supply a toner pattern and a toner band described hereinafter.

As illustrated in FIG. 2, image forming apparatus 1 includes image reading section 10, operation/display section 20, image processing section 30, image forming section 40, sheet conveying section 50, fixing section 60, image detection section 80, and control section 100, for example.

Control section 100 includes central processing unit (CPU) 101, read only memory (ROM) 102, and random access memory (RAM) 103, for example. CPU 101 reads a program corresponding to processing details from ROM 102, loads the program into RAM 103, and performs, cooperatively with the loaded program, centralized control of the operations of respective blocks of image forming apparatus 1. During this step, various data stored in storage section 72 are referred to. Storage section 72 is composed of, for example, a nonvolatile semiconductor memory (so-called flash memory) and/or a hard disk drive.

Control section 100 transmits and receives various data to and from an external apparatus (personal computer, for example) connected to a communication network, such as a local area network (LAN) or a wide area network (WAN), via communication section 71. Control section 100, for example, receives image data transmitted from an external apparatus, and causes an image to be formed on sheet S on the basis of the image data (input image data). Communication section 71 is composed of, for example, a network interface card, such as a LAN adapter.

Image reading section 10 includes auto document feeder (ADF) 11 and document image scanner 12, for example.

Auto document feeder 11 conveys, by a conveying mechanism, document D placed on a document tray and sends it out to document image scanner 12. Auto document feeder 11 can simultaneously and continuously read images on many documents D placed on a document tray (both sides included).

Document image scanner 12 optically scans documents conveyed from auto document feeder 11 onto a contact glass or documents placed on a contract glass, and images reflected light from the documents on a light receiving surface of charge coupled device (CCD) sensor 12*a* to read document images. Image reading section 10 generates input image data based on results read by document image scanner 12. The input image data undergoes predetermined image processing in image processing section 30.

Operation/display section 20 is composed of, for example, a touch panel-type liquid crystal display (LCD), and functions as both display section 21 and operation section 22. Display section 21 displays, for example, various operation screens, the state of images, the operation status of each function in accordance with display control signals input from control section 100. Operation section 22 equipped with various operation keys, such as a numeric keypad and a start key, receives various input operations by a user and outputs operation signals to control section 100.

Image processing section 30 includes, for example, a circuit that performs digital image processing of input image data in accordance with default settings or user settings. For example, image processing section 30 performs tone correction based on tone correction data (tone correction table LUT) in storage section 72 under the control of control section 100. Moreover, image processing section 30 performs, for example, various correction processing, such as color correction or shading correction, in addition to tone correction, and/or compression processing of input image data. Image forming section 40 is controlled on the basis of the thus-processed image data.

Image forming section 40 includes, for example, intermediate transfer unit 42 and image forming units 41T, 41Y, 41M, 41C, and 41K for forming images of respective color toners of T component, Y component, M component, C component, and K component, on the basis of input image data.

Image forming units 41T, 41Y, 41M, 41C, and 41K for T component, Y component, M component, C component, and K component have similar configurations. For the purpose of convenience in illustration and description, common components are denoted by the same numerals while the numerals are accompanied by T, Y, M, C, or K when they are distinguished from each other. In FIG. 1, only components of image forming unit 41T for T component are denoted by numerals, and numerals are omitted for components of other image forming units 41Y, 41M, 41C, and 41K.

Image forming unit 41 includes exposing device 411, developing device 412, photoconductor drum 413, charging device 414, and drum cleaning device 415, for example.

Photoconductor drum 413 is, for example, a negative-charging organic photoconductor (OPC) formed by successively stacking an undercoat layer (UCL), a charge generation layer (CGL), and a charge transport layer (CTL) on a peripheral surface of an aluminum conductive cylinder (aluminum tube). The charge generation layer is formed of an organic semiconductor in which a charge generation material (phthalocyanine pigment, for example) is dispersed in a resin binder (polycarbonate, for example), and generates pairs of positive and negative charges upon exposure by exposing device 411. The charge transport layer is formed of a hole transport material (electron-donating nitrogen-containing compound) dispersed in a resin binder (polycarbonate, for example), and transports positive charges generated in the charge generation layer to the surface of the charge transport layer.

Control section 100 causes photoconductor drum 413 to rotate at a constant peripheral speed (linear velocity) by controlling driving current supplied to a driving motor (not shown) for rotating photoconductor drum 413.

Charging device 414 evenly and negatively charges the surface of photoconductor drum 413. Exposing device 411 is composed of a semiconductor laser, for example, and irradiates photoconductor drum 413 with laser beams corresponding to images of respective color components. Surface charges (negative charges) of photoconductor drum 413 are neutralized by positive charges that are generated in the charge generation layer of photoconductor drum 413 and transported to the surface of the charge transport layer. An electrostatic latent image of each color component is formed on the surface of photoconductor drum 413 by a potential difference from the surroundings.

Developing device 412 is, for example, a developing device of a two-component developing system, and forms a toner image by attaching a toner of each color component to the surface of photoconductor drum 413 to visualize an electrostatic latent image.

Drum cleaning device 415 includes, for example, drum cleaning blade (hereinafter, simply referred to as cleaning blade) 416 as a cleaning member that is slid on the surface of photoconductor drum 413. Drum cleaning device 415 removes transfer residual toner remaining on the surface of photoconductor drum 413 by cleaning blade 416 after primary transfer. In the embodiment, cleaning blade 416 is a plate-like member made of urethane rubber.

Intermediate transfer unit 42 includes intermediate transfer belt 421 as an image bearing member, primary transfer roller 422, a plurality of support rollers 423, secondary transfer roller 424, and belt cleaning device 426, for example.

Intermediate transfer belt 421 is composed of an endless belt, and looped around a plurality of support rollers 423 under tension. At least one of a plurality of support rollers 423 is a driving roller, and the rest are driven rollers. For example, roller 423A disposed on the downstream side of primary transfer roller 422 for K component in the running direction of the belt is preferably a driving roller. Such a configuration facilitates retention of a constant running speed of the belt in a primary transfer section. Intermediate transfer belt 421 runs in arrow A direction at a constant speed by the rotation of driving roller 423A.

Primary transfer roller 422 is disposed, on the side of an inner peripheral surface of intermediate transfer belt 421, so as to face photoconductor drum 413 of each color component. A primary transfer nip, for transferring a toner image to intermediate transfer belt 421 from photoconductor drum 413, is formed by firmly pressing primary transfer roller 422 against photoconductor drum 413 via intermediate transfer belt 421.

Secondary transfer roller 424 is disposed on the side of an outer peripheral surface of intermediate transfer belt 421 so as to face backup roller 423B that is disposed on the downstream side of driving roller 423A in the running direction of the belt. A secondary nip, for transferring a toner image to sheet S from intermediate transfer belt 421, is formed by firmly pressing secondary transfer roller 424 against backup roller 423B via intermediate transfer belt 421.

When intermediate transfer belt 421 passes through the primary transfer nip, toner images on photoconductor drums 413 are successively superimposed and transferred to intermediate transfer belt 421 (primary transfer). Specifically, toner images are electrostatically transferred to intermediate transfer belt 421 by applying primary transfer bias to primary transfer roller 422 thereby imparting charges of opposite polarity to toners to the rear side (contact side with primary transfer roller 422) of intermediate transfer belt 421.

Subsequently, when sheet S passes through the secondary transfer nip, toner images on intermediate transfer belt 421 are transferred to sheet S (secondary transfer). Specifically, toner images are electrostatically transferred to sheet S by applying secondary transfer bias to secondary transfer roller 424 thereby imparting charges of opposite polarity to toners to the rear side (contact side with secondary transfer roller 424) of sheet S. Sheet S bearing the transferred toner images is then conveyed to fixing section 60.

Belt cleaning device 426 includes, for example, belt cleaning blade 427 that slides on the surface of intermediate transfer belt 421, and removes transfer residual toner remaining on the surface of intermediate transfer belt 421 after secondary transfer. In place of secondary transfer roller 424, a configuration in which a secondary transfer belt is looped around a plurality of support rollers including a secondary transfer roller under tension (so-called belt-type secondary transfer unit) may be employed.

Fixing section 60 includes upper fixing section 60A equipped with a fixing-side member that is disposed on the fixing side (toner image-formed side) of sheet S, lower fixing section 60B equipped with a rear-side support member that is disposed on the rear side (the side opposite to the fixing side) of sheet S, and a heating source, for example. A fixing nip, for pinching and conveying sheet S, is formed by firmly pressing the rear-side support member against the fixing-side member.

Upper fixing section 60A includes endless fixing belt 61 as the fixing-side member, heating roller 62, and upper pressure roller 63 (belt heating mode). Fixing belt 61 is extended over heating roller 62 and upper pressure roller 63 under a predetermined belt tension (400 N, for example). Fixing belt 61 includes a base formed of a polyimide (PI), for example, an elastic layer of heat-resistant silicone rubber that covers the outer peripheral surface of the base, and a surface layer of a tube or a coating formed of a perfluoroalkoxy alkane (PFA) as a heat-resistant resin. Fixing belt 61 comes into contact with sheet S bearing formed toner images, and heat-fixes the toner images to sheet S within a temperature range allowable for fixing. The temperature range allowable for fixing herein means a temperature range that can supply energy required for melting toner on sheet S and that varies depending on, for example, types of sheet S in which images are to be formed.

Heating roller 62 heats fixing belt 61. Heating roller 62 includes a built-in heating source for heating fixing belt 61. Heating roller 62 is a halogen heater, for example, and includes a cylindrical core formed of aluminum or the like, and a resin layer that is formed by applying PTFE to the outer peripheral surface of the core so as to cover the core. The temperature of the heating source is controlled by control section 100. Heating roller 62 is heated by the heating source, thereby heating fixing belt 61.

Upper pressure roller 63 includes a solid core formed of metal, such as iron, and an elastic layer that covers the core.

Heat-resistant silicone rubber, for example, can be used as a material for the elastic layer. The elastic layer can also be heat-resistant silicone rubber covered with a resin layer that is formed by applying PTFE as a low-friction heat-resistant resin. Upper pressure roller 63 is firmly pressed against lower pressure roller 66 via fixing belt 61.

Lower fixing section 60B includes lower pressure roller 66 as the rear-side support member (roller pressing mode). Lower pressure roller 66 includes a polyimide (PI) base layer and an elastic layer that covers the outer peripheral surface of the base layer. Heat-resistant silicone rubber, for example, can be used as a material for the elastic layer. The elastic layer can also be heat-resistant silicone rubber covered with a PFA tube resin layer as a surface release layer.

Lower pressure roller 66 includes a built-in heating source, such as a halogen heater. The heating source generates heat, thereby heating lower pressure roller 66. Control section 100 controls electric power supplied to the heating source, thereby controlling lower pressure roller 66 at a predetermined temperature.

Lower pressure roller 66 is firmly pressed against upper pressure roller 63 via fixing belt 61 under a predetermined fixing load. In the above configuration, a fixing nip for pinching and conveying sheet S is formed between upper pressure roller 63/fixing belt 61, and lower pressure roller 66.

Fixing section 60 heats and presses conveyed sheet S in which toner images have been transferred (secondary transfer), thereby fixing the toner images on sheet S. Fixing section 60 is disposed, as a unit, inside fixing device F.

Sheet conveying section 50 includes sheet feeding section 51, sheet ejection section 52, and conveying path section 53, for example. Three sheet feeding tray units 51*a* to 51*c* , which constitute sheet feeding section 51, store sheets S (standard paper, special paper) classified, based on basis weight and/or size, for example, in accordance with predetermined types. Conveying path section 53 includes a plurality of conveyance roller pairs, such as registration roller pair 53*a*.

Sheets S stored in sheet feeding tray units 51*a* to 51*c* are each sent out from the uppermost portion one by one and conveyed to image forming section 40 through conveying path section 53. During this step, a registration roller section, where registration roller pair 53*a* is disposed, corrects the tilt of sheets S and adjusts the timing of conveyance. Toner images on intermediate transfer belt 421 are then transferred collectively to one side of sheet S in image forming section 40 (secondary transfer), and undergo a fixing step in fixing section 60. Sheet S bearing a formed image is ejected outside the apparatus by sheet ejection section 52 equipped with ejection roller pair 52*a*.

Image detection section 80 that detects toner images on sheet S by commonly known image scanners, for example, is provided on the downstream side of fixing section 60 in the conveying direction of sheet S. In the embodiment, image detection section 80 is an image reading section that reads toner images on both front and rear sides of sheet S, and serves to detect toner that has slipped through a cleaning blade after a toner pattern for cleaning blade inspection described hereinafter has been allowed to reach the cleaning blade.

Figure 3:
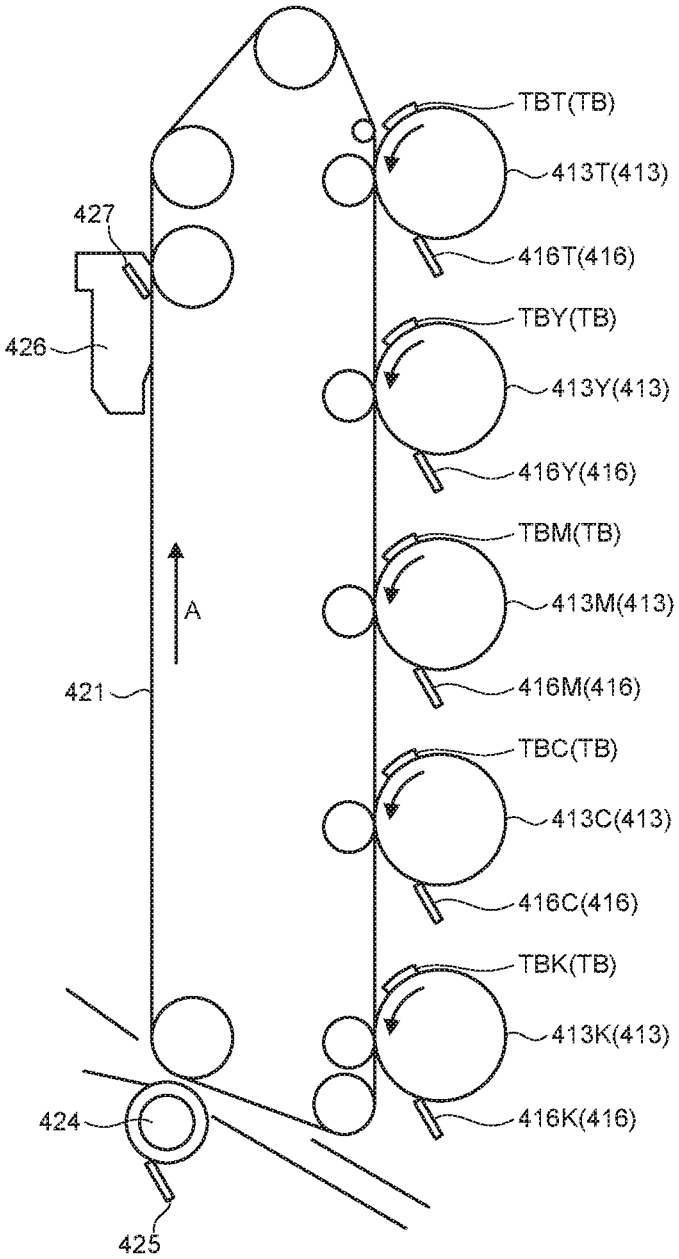
FIG. 3 is a view of part of the image forming apparatus and illustrates an operation of supplying a toner band to each cleaning blade.

In the following, cleaning blades of image forming apparatus 1 will be described with reference to FIG. 3 that illustrates part of image forming section 40. As illustrated in FIG. 3, in the embodiment, cleaning blades 416T, 416Y, 416M, 416C, and 416K, are provided so as to come into contact with the corresponding five photoconductor drums 413T, 413Y, 413M, 413C, and 413K in the counter direction. For secondary transfer roller 424, roller cleaning blade (hereinafter, simply referred to as cleaning blade) 425 for removing residual toner on the surface of the roller is provided so as to come into contact with secondary transfer roller 424 in the counter direction. Further, for belt cleaning device 426, the above-mentioned belt cleaning blade (hereinafter, simply referred to as cleaning blade) 427 is provided so as to come into contact with the surface of intermediate transfer belt 421 in the counter direction.

Such counter-mode cleaning blades 416, 425, and 427 have advantages of simple configurations, low costs, and high removal performance of toner.

In the following, secondary transfer roller 424 will also be described as an image bearing member.

Figure 4:
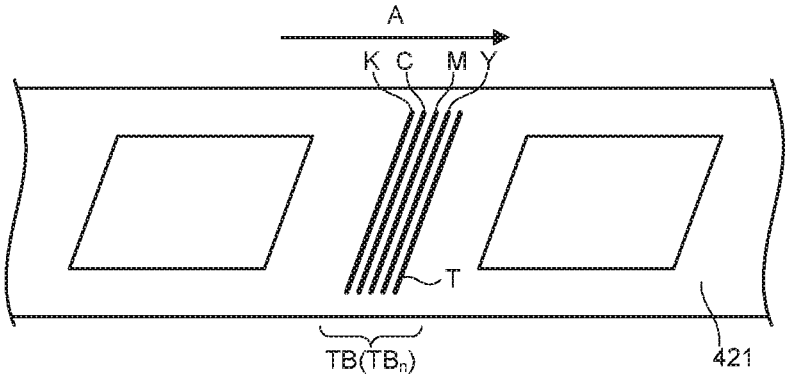
FIG. 4 illustrates normal toner bands transferred to an intermediate transfer belt.

When the states of cleaning blades 416, 425, and 427 deteriorate due to abrasion or the like, normal cleaning off of residual toner on image bearing members becomes impossible and streaks of toner stains, for example, arise on image bearing members. Transfer of such stains to sheet S results in a problem, i.e., the occurrence of image defects. Accordingly, as illustrated in FIG. 4, control section 100 performs control such that a toner pattern (toner bands TB) as a lubricant is regularly supplied to cleaning blades 416, 425, and 427, thereby imparting lubricity to the cleaning blades.

Different from a toner image (print image) formed on the basis of input image data during execution of a print job, such toner bands TB are supplied to an image bearing member while no sheet is fed. Toner bands TB are formed by developing band patterns of the respective colors (TYMCK in the example of FIG. 4) in nearly the same shape.

As a detailed description with reference to FIG. 3, toner bands TB consist of transparent tonner band TBT, yellow toner band TBY, cyan toner band TBC, magenta toner band TBM, and black toner band TBK. The respective color toner bands are successively formed (developed) on the corresponding photoconductor drums 413T, 413Y, 413M, 413C, and 413K.

Color toner bands developed on each photoconductor drum 413 are transferred onto intermediate transfer belt 421 (primary transfer) so as to come close to each other (see FIG. 4) to form toner bands TB. Meanwhile, residual portion of each toner band that has not been transferred in primary transfer is removed by the corresponding cleaning blade 416, thereby imparting lubricity to the cleaning blade 416. For example, control for allocating toner bands to photoconductor drum 413, intermediate transfer belt 421, and secondary transfer roller 424 will be described hereinafter.

Toner bands TB, which are transferred onto intermediate transfer belt 421 (primary transfer) and passed through secondary transfer roller 424 while no sheet is fed, are partially attached (allocated) to secondary transfer roller 424. Toner bands TB allocated to secondary transfer roller 424 are wiped off by cleaning blade 425, thereby imparting lubricity to cleaning blade 425.

Further, toner bands TB that have not been attached to secondary transfer roller 424 partially remain on intermediate transfer belt 421 and are supplied to cleaning blade 427 of belt cleaning device 426, thereby imparting lubricity to cleaning blade 427.

A timing of and/or an interval for supplying such toner bands TB are not limited, and toner bands TB can be supplied between printed images during execution of print jobs (see FIG. 4). Control section 100 records, for example, the running distance of intermediate transfer belt 421 during execution of print jobs, and performs control such that toner bands TB are supplied when the running distance reaches a preset running distance. By performing such control for regularly supplying toner bands TB to cleaning blades 416, 425, and 427, unnecessary rise in frictional force on contact portions of cleaning blades 416, 425, and 427 with image bearing members is suppressed.

Meanwhile, the abraded states of cleaning blades 416, 425, and 427 vary depending on various factors, such as the environment like a temperature, humidity, or the like, the usage (a type and/or size of a sheet used, for example), as well as the sliding distance. Accordingly, it is not easy to estimate the life. Consequently, in some cases, cleaning failure, in which toner slips through cleaning blades 416, 425, and/or 427, arises before the life set by a standard or the like is reached, and printed image defects result due to such cleaning failure.

The states of non-abraded cleaning blades 416, 425, and/or 427 temporarily deteriorate and cause cleaning failure due to the above-mentioned slipping phenomenon of toner and thus resulting image defects in some cases, such as when the cleaning blades locally hold an extraneous material, or when the rubber blades are stiffened by frictional force between the rubber blades and image bearing members.

The abrasion-caused deteriorated states or the above-mentioned temporarily deteriorated states of cleaning blades 416, 425, and/or 427 typically arise in part of the width direction of the contact portions that are in contact with image bearing members, but not in the whole width direction. Accordingly, slipping phenomenon of toner arises in part of the width direction, i.e., in a deteriorated site. Such slipping phenomenon of toner causes streaks of toner stains, for example, on image bearing members. Transfer of such toner stains on the image bearing members to sheet S causes a problem in which images output on sheet S deteriorate and thus image defects arise.

In view of the above, in the embodiment, control section 100 performs control on a cleaning failure detection mode in which a toner pattern for cleaning blade inspection is supplied to cleaning blades 416, 425, and/or 427 corresponding to the operation status and the like of image forming apparatus 1, and the states of the cleaning blades are inspected.

As for the outline of the cleaning failure detection mode, control section 100 performs control such that a contact portion of each cleaning blade 416, 425, or 427 with the corresponding image bearing member becomes a state in which cleaning failure, i.e., slipping of toner, readily occurs.

More specifically, in the cleaning failure detection mode, control section 100 generates, in place of the above-mentioned toner bands TB (first toner pattern), high-strain toner bands with a larger amount of toner per unit area than toner bands TB as a second toner pattern.

Control section 100 supplies the generated high-strain toner bands, as toner patterns for cleaning blade inspection, to image bearing members on the upstream side of cleaning blades 416, 425, and/or 427 in the toner traveling direction, and causes cleaning blades 416, 425, and/or 427 to clean off the high-strain toner bands.

Control section 100 also performs control such that sheet S is fed after cleaning off of such high-strain toner bands is performed, the high-strain toner bands remaining on the image bearing members are transferred to sheet S, and sheet S is scanned by image detection section 80 after a fixing process in fixing section 60. Subsequently, control section 100 identifies, on the basis of a detected result by image detection section 80, a defective site in a contact portion of cleaning blade 416, 425, or 427, in other words, a (high-risk) portion in which slipping of toner images based on input image information readily occurs.

Once a defective site in a contact portion of cleaning blade 416, 425, or 427 is identified, control section 100 performs control such that a toner pattern whose supply mode of toner to the defective site is changed from a supply mode before the defective site has been identified is supplied to the cleaning blade in which the defective site has been identified.

More specifically, control section 100 performs control such that the high-strain toner band (a toner pattern for cleaning blade inspection) at least one of whose shape, amount, and type is changed corresponding to the defective site, in other words, corresponding to the position in the width direction of the cleaning blade, is supplied to an image bearing member with which the cleaning blade is in contact.

A high-strain toner band herein indicates a toner band in which the amount of toner per unit area is increased so that the above-mentioned slipping phenomenon of toner readily occurs, in other words, a toner band that increases strain on cleaning blades 416, 425, and/or 427 during cleaning, relative to the toner bands TB. By supplying a higher-strain toner band than usual, slipping of toner occurs first in part of cleaning blades 416, 425, and/or 427 with a relatively high degree of abrasion. Accordingly, it becomes possible to identify a relatively deteriorated site in a contact portion of a blade before image defects arise during execution of a print job.

Hereinafter, in order to distinguish such two toner bands, the former (first toner pattern) is referred to as normal toner bands TB. (see FIG. 4), and the latter (second toner pattern) is referred to as high-strain toner bands $TB_S$ (see FIG. 5).

Control section 100 thus identifies a cleaning blade in which slipping of toner occurs, as well as its position, based on output signals from image detection section 80, which indicate cleaning results of high-strain bands $TB_S$ by cleaning blades 416, 425, and 427.

Figure 5:
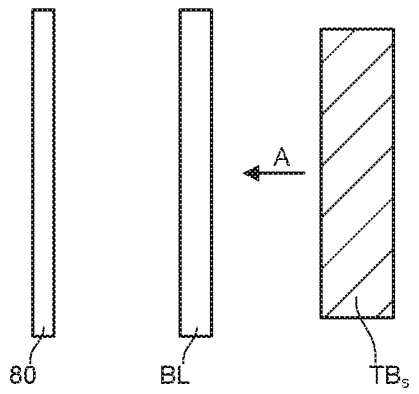
FIG. 5 is a view illustrating the outline of control for causing each cleaning blade to clean off a high-strain toner band.
Figure 6:
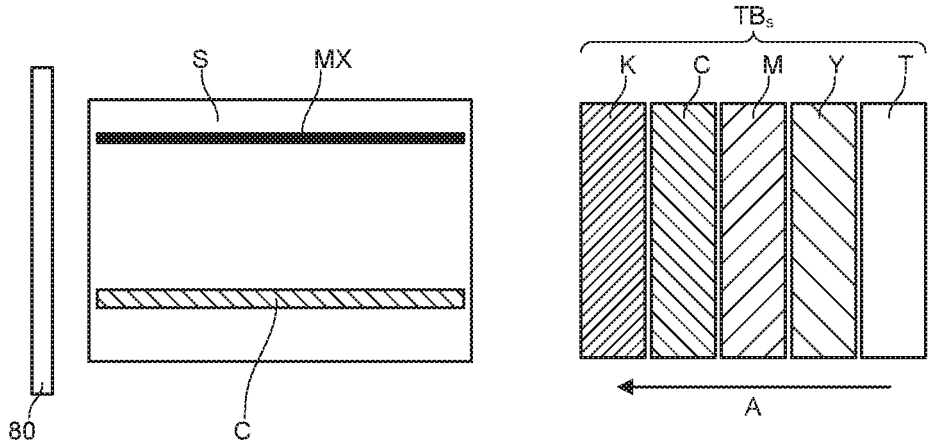
FIG. 6 illustrates an example configuration of high-strain toner bands and a state in which slipped toner is attached to a sheet, for example.

As a more specific description with reference to FIG. 5 and FIG. 6, control section 100 performs control such that sheet S is conveyed after cleaning off of high-strain toner bands $TB_S$ is performed, and the states of both sides of sheet S are detected by image detection section 80 (scanning in the sheet width direction). On the basis of a width-direction position of toner on sheet S and the side (front or rear) of sheet S detected by image detection section 80, control section 100 then identifies a width-direction position of a cleaning blade (hereinafter, abbreviated as "blade" as appropriate) BL in which slipping of toner has occurred and the blade itself (i.e., any of blades 416T, 416Y, 416M, 416C, 416K, 427, and 425).

FIG. 6 illustrates an example in which a toner streak of cyan C and a toner streak of mixed color MX arise on the front side of sheet S as a result of performing cleaning off of high-strain bands $TB_S$ by blades 416, 427, and 425. In the example of FIG. 6, as for the toner streak of cyan C detected by image detection section 80, control section 100 determines that blade 416C that is in contact with cyan photoconductor drum 413C has caused slipping of toner. As for the toner streak of mixed color MX detected by image detection section 80, control section 100 determines that blade 427 that is in contact with intermediate transfer belt 421 has caused slipping of toner. Meanwhile, if a toner streak of mixed color MX is detected on the rear side of sheet S by image detection section 80, control section 100 determines that blade 425 that is in contact with secondary transfer roller 424 has caused slipping of toner. Mechanisms, for example, for such identification of blades BL will be described hereinafter.

As in the foregoing, control section 100 assumes that a blade (any of 416T, 416Y, 416M, 416C, 416K, 427, and 425) that has caused slipping of toner and its portion are respectively a cleaning blade and a portion (defective site) that are prone to slipping of toner images (i.e., toner to be developed on the basis of input image information) during execution of a print job. For blade BL identified in the assumption, control section 100 then performs control such that an operation for preventing the occurrence of image defects during execution of a print job and achieving long-term use of the blade is executed.

By regularly performing control by the cleaning failure detection mode in which determination of the state of a cleaning blade and the corresponding operation are performed, it becomes possible to prevent the occurrence of image defects during execution of a print job and to realize long-term use of cleaning blades 416, 425, and 427.

In the following, control details in the cleaning failure detection mode will be described in further detail.

First, control for supplying high-strain toner bands $TB_S$ to each blade 416 (416T, 416Y, 416M, 416C, 416K), 425, or 427 will be described.

Control section 100 performs control such that high-strain toner bands $TB_S$ are generated and supplied to each cleaning blade 416, 425, or 427 at an interval set by taking account of the life (sliding distance and use status, for example) of each cleaning blade 416, 425, or 427.

In the embodiment, control section 100 records, in storage section 72, the sliding distance for every cleaning blade 416 (416T, 416Y, 416M, 416C, 416K), 425, or 427 as sliding distance information, and performs control such that high-strain toner bands $TB_S$ are generated and supplied to a cleaning blade when its sliding distance exceeds a preset value.

Moreover, every time when a print job is executed, control section 100 records, in storage section 72, the coverage of the print job as coverage information, and performs control such that high-strain toner bands $TB_S$ are generated and supplied to each cleaning blade 416 (416T, 416Y, 416M, 416C, 416K), 425, or 427 when an image forming operation at a low coverage equal to or lower than a preset value (in this example, a coverage of 3% or lower) continues.

For comparison, control for generating and supplying normal toner bands $TB_n$ to each blade will be described before control for generating high-strain toner bands $TB_s$ and the like will be described.

(Control for Generating and Supplying Normal Toner Bands $TB_n$ to Each Blade 416, 425, or 427)

Control section 100 develops each TYMCK color toner pattern that constitutes normal toner bands $TB_n$ (hereinafter, referred to as a "normal toner pattern" to distinguish from normal toner bands $TB_n$) on each photoconductor drum 413T, 413Y, 413M, 413C, or 413K. Such normal toner pattern is, for example, 2 g/m$^2$ of each TYMCK color toner shaped into a 2 mm×330 mm band (see FIG. 3 and FIG. 4).

Subsequently, by adjusting primary transfer output (transfer rate), control section 100 causes the normal toner patterns to be transferred to intermediate transfer belt 421 (primary transfer) at a predetermined transfer rate (50%, for example), thereby forming normal toner bands $TB_n$ on intermediate transfer belt 421 (see FIG. 4). At a transfer rate of 50%, 1 g/m$^2$ of each TYMCK toner pattern (5 g in total) is transferred onto intermediate transfer belt 421 as normal toner bands $TB_n$ (primary transfer), whereas 1 g/m$^2$ of each toner pattern (TYMCK) remains on the corresponding photoconductor drum 413T, 413Y, 413M, 413C, or 413K.

Each toner pattern (TYMCK) remaining on photoconductor drum 413T, 413Y, 413M, 413C, or 413K is removed later by corresponding cleaning blade 416T, 416Y, 416M, 416C, or 416K.

Moreover, by adjusting secondary transfer output, control section 100 transfers normal toner bands $TB_n$ formed on intermediate transfer belt 421 to secondary transfer roller 424 (secondary transfer) at a predetermined transfer rate (50%, for example). At a transfer rate of 50%, 0.5 g/m$^2$ of each TYMCK toner pattern (2.5 g of normal toner bands $TB_n$ in total) is transferred to secondary transfer roller 424 (secondary transfer), whereas the same 2.5 g of normal toner bands $TB_n$ in total remain on intermediate transfer belt 421.

Normal toner bands $TB_n$ transferred to secondary transfer roller 424 (secondary transfer) is later removed by cleaning blade 425. Normal toner bands $TB_n$ remaining on intermediate transfer belt 421 is later removed by cleaning blade 427.

The above-mentioned transfer rate and amount of toner are examples, and such values can be adjusted as appropriate.

In the following, control for a case in which high-strain toner bands $TB_S$ are generated will be described. Each value in the case in which high-strain toner bands $TB_S$ are generated can also be adjusted as appropriate, similar to the foregoing.

(Control for Generating High-Strain Toner Bands TBs)

Control section 100 develops, on five photoconductor drums 413T, 413Y, 413M, 413C, and 413K, toner patterns that constitute high-strain toner bands $TB_S$ (hereinafter, referred to as high-strain toner patterns for differentiation). Such high-strain toner patterns may be the same shape and amount as the above-mentioned normal toner patterns, or the amount per unit area may be increased relative to the normal toner patterns.

(Inspection of Blade 416 that is in Contact with Photoconductor Drum 413)

When the state of cleaning blade 416 that is in contact with photoconductor drum 413 is inspected, by switching off primary transfer output, control section 100 supplies all the high-strain toner patterns (2 g/m$^2$ of each TYMCK color toner patterned into a 2 mm×330 mm band, for example) to the corresponding blades 416T, 416Y, 416M, 416C, and 416K without transferring to intermediate transfer belt 421 (without primary transfer).

In this case, when all the blades 416T, 416Y, 416M, 416C, and 416K are normal, all the high-strain toner patterns on the corresponding photoconductor drums 413 are removed by blades 416 that are in contact therewith and no slipping of toner occurs. In contrast, when one or more cleaning blades 416T, 416Y, 416M, 416C, and 416K partially deteriorate (in a case in which abrasion or a temporarily failed state, such as stiffening, arises; the same will apply hereinafter), a high-strain toner pattern of the corresponding color (i.e., one or more TYMCK toners) partially slips and remains on the corresponding photoconductor drum 413 (see FIG. 7A).

Control section 100 switches on primary transfer output after cleaning off of all the TYMCK high-strain toner patterns by cleaning blades 416. Through such control, the slipped high-strain toner pattern is transferred to intermediate transfer belt 421 from the corresponding photoconductor drum 413 (primary transfer). Further, control section 100 performs control such that sheet S is fed to a secondary transfer section at a timing when the slipped toner passes through the secondary transfer section. Through this control, the slipped toner is transferred to the front side of sheet S from intermediate transfer belt 421 (secondary transfer). Subsequently, sheet S undergoes a fixing process by fixing section 60 and both sides of sheet S are scanned by image detection section 80.

Control section 100 determines whether cleaning failure occurs in any of cleaning blades 416T, 416Y, 416M, 416C, and 416K, based on scanned results of the front side of sheet S by image detection section 80. Specifically, when neither of TYMCK toners is detected on the front side of sheet S, control section 100 determines that no cleaning failure occurs, and thus all the blades 416T, 416Y, 416M, 416C, and 416K that are in contact with respective photoconductor drums 413 are normal. In contrast, when one or more YMCK toners (toner streaks mentioned above in connection with FIG. 6) are detected on the front side of sheet S, control section 100 determines that cleaning failure occurs in blade 416 that cleans off the corresponding color.

(Inspection of Blade 427 that is in Contact with Intermediate Transfer Belt 421)

When the state of cleaning blade 427 that is in contact with intermediate transfer belt 421 is inspected, control section 100 switches on primary transfer output so as to transfer all the high-strain toner patterns (i.e., high-strain toner bands TBs) to intermediate transfer belt 421. Further, control section 100 switches off secondary transfer output such that high-strain toner bands $TB_S$ are not attached to secondary transfer roller 424 (i.e., passed through), and performs cleaning off of high-strain toner bands $TB_S$ by blade 427.

In this case, when cleaning blade 427 is normal, all the high-strain toner bands TBs on intermediate transfer belt 421 are removed by blade 427 and thus no slipping of toner occurs. In contrast, when cleaning blade 427 has partially deteriorated, high-strain toner bands TBs, i.e., TYMCK high-strain toner patterns, partially slip through and remain on intermediate transfer belt 421 as a mixed color.

Accordingly, control section 100 switches on secondary transfer output after high-strain toner bands $TB_S$ are cleaned off by cleaning blade 427, and performs control such that sheet S is fed to the secondary transfer section at a timing when the slipped toner passes through the secondary transfer section. Through this control, the slipped toner is transferred to the front side of sheet S from intermediate transfer belt 421 (secondary transfer). Subsequently, sheet S undergoes a fixing process by fixing section 60 and both sides of sheet S are scanned by image detection section 80.

Control section 100 determines whether cleaning failure occurs in cleaning blade 427, based on a scanned result of the front side of sheet S by image detection section 80. Specifically, when no toner of a mixed color is detected on the front side of sheet S, control section 100 determines that no cleaning failure occurs and thus blade 427 that is in contact with intermediate transfer belt 421 is normal. In contrast, when toner of a mixed color (a toner streak of a mixed color mentioned above in connection with FIG. 6) is detected on the front side of sheet S, control section 100 determines that cleaning failure occurs in blade 427.

(Inspection of Blade 425 that is in Contact with Secondary Transfer Roller 424)

When the state of cleaning blade 425 that is in contact with secondary transfer roller 424 is inspected, control section 100 switches on primary transfer output so as to transfer all high-strain toner patterns (i.e., high-strain toner bands TBs) to intermediate transfer belt 421. Moreover, control section 100 switches on secondary transfer output such that high-strain toner bands $TB_S$ are attached to secondary transfer roller 424, and performs cleaning off of high-strain toner bands $TB_S$ by cleaning blade 425.

In this case, when cleaning blade 425 is normal, all the high-strain toner bands $TB_S$ on secondary transfer roller 424 are removed by cleaning blade 425 and thus no slipping of toner occurs. In contrast, when cleaning blade 425 has partially deteriorated, high-strain toner bands $TB_S$ (TYMCK high-strain toner patterns) partially slip and remain on secondary transfer roller 424 as a mixed color.

Accordingly, control section 100 switches on secondary transfer output after high-strain toner bands $TB_S$ are cleaned off by cleaning blade 425, and performs control such that sheet S is fed to a secondary transfer section at a timing when slipped toner passes through a secondary transfer nip. Through such control, the slipped toner is transferred to the rear side of sheet S from secondary transfer roller 424. Subsequently, sheet S undergoes a fixing process by fixing section 60 and both sides of sheet S are scanned by image detection section 80.

Control section 100 determines whether cleaning failure occurs in cleaning blade 425, based on a scanned result of the rear side of sheet S by image detection section 80. Specifically, when toner of a mixed color is not detected on the rear side of sheet S, control section 100 determines that no cleaning failure occurs and thus blade 425 that is in contact with intermediate transfer belt 421 is normal. In contrast, when toner of a mixed color (toner streak) is detected on the rear side of sheet S, control section 100 determines that cleaning failure occurs in blade 425.

(Case of Simultaneously Supplying High-Strain Toner Patterns or Bands to all Cleaning Blades)

Through control similar to that in the case of generating normal toner bands $TB_n$, control section 100 can simultaneously supply high-strain toner patterns or high-strain toner bands $TB_S$ to all the cleaning blades 416, 427, and 425.

Specifically, control section 100 develops high-strain toner patterns, in which each TYMCK color toner that constitutes high-strain toner bands $TB_S$ is shaped into a 2 mm×330 mm band using, for example, 6 g/m$^2$ of each toner, on the corresponding photoconductor drums 413Y, 413M, 413C, and 413K. Moreover, control section 100 causes such high-strain toner patterns to be transferred onto intermediate transfer belt 421 at a transfer rate of about 67% (⅔) whereas the remaining ⅓ (i.e., 2 g/m$^2$) of the high-strain toner patterns are removed by the corresponding cleaning blades 416 (T, Y, M, C, K).

Further, control section 100 performs control such that ⅔ of high-strain toner bands $TB_S$ transferred onto intermediate transfer belt 421 (primary transfer), i.e., a total of 20 g high-strain toner bands $TB_S$ consisting of high-strain toner patterns of each 4 g/m$^2$ TYMCK toner, are transferred onto secondary transfer roller 424 (secondary transfer) at a transfer rate of 50%. Accordingly, a total of 10 g high-strain toner bands $TB_S$ transferred to secondary transfer roller 424 (secondary transfer) are later removed by cleaning blade 425. Meanwhile, a total of 10 g high-strain toner bands $TB_S$ remaining on intermediate transfer belt 421 are later removed by cleaning blade 427.

Control section 100 performs control such that sheet S is fed after performing wiping by each cleaning blade 416 (T, Y, M, C, K), 425, or 427, and both sides of sheet S are scanned by image detection section 80. Subsequently, control section 100 determines whether cleaning failure occurs in any of the blades in a similar manner as described above, i.e., based on a color of toner (single color or mixed color) and a side of sheet S (front or rear) detected by image detection section 80.

In the embodiment, through the above-described control and determination, it becomes possible to identify in advance a portion of a cleaning blade (defective site) with a high risk of the occurrence of slipping of toner images on the basis of input image information. Further, control section 100 performs control such that an operation for preventing the occurrence of image defects and achieving long-term use of the blade is executed for the thus-identified portion of the cleaning blade.

As the control of such an operation, control section 100 performs control such that toner patterns, in which at least one of the shape, the amount, and the type of the above-mentioned high-strain toner patterns or high-strain toner bands $TB_S$ (i.e., toner patterns for cleaning blade inspection) has been changed corresponding to a position of the defective site, i.e., a position in the blade width direction, are supplied to an image bearing member that is in contact with the cleaning blade in which the defective site has been identified. Examples of thus-changed toner patterns will be described with reference to FIG. 7 to FIG. 11.

Figure 7A:
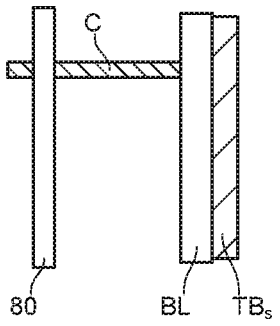
FIG. 7A and FIG. 7B are views illustrating operations when slippage occurs during cleaning off of the high-strain toner bands.

FIG. 7A illustrates a case in which blade BL that has caused slipping of toner during cleaning off of high-strain toner bands $TB_S$ is blade 416C that is in contact with cyan (C) photoconductor drum 413C. FIG. 7B to FIG. 11 illustrate various modes of toner patterns when cyan (C) toner pattern whose shape, for example, has been changed in the example illustrated in FIG. 7A is supplied to photoconductor drum 413C and cleaning blade 416C.

Figure 7B:
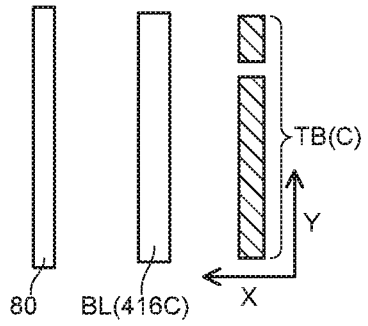
Figure 8A:
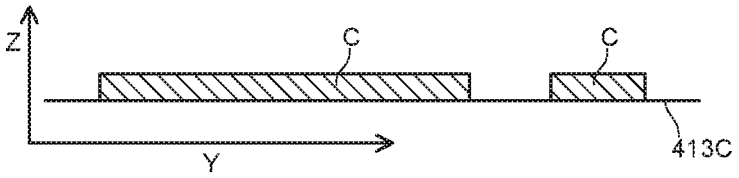
FIG. 8A to FIG. 8C illustrate, in views from the traveling direction of toner, various modes of toner bands supplied after detection of slippage.

In this case, as illustrated in FIG. 7B and FIG. 8A, for example, control section 100 performs control such that a cyan (C) toner band TB (C), which is shaped so that no toner is supplied only to a site of blade 416C that has caused slipping of toner (hereinafter, referred to as "slippage portion"), is developed on photoconductor drum 413C. By subsequent wiping of such toner band TB (C) by blade 416C, it becomes possible to prevent another slipping of toner in the slippage portion while imparting lubricity to a contact portion of blade 416C.

Such toner bands, which are supplied to blade BL that has caused slipping of toner after the slipping of toner has been detected, can adopt various modes as illustrated in FIG. 8B and FIG. 8C, FIG. 9A to FIG. 9F, FIG. 10A to FIG. 10C, and FIG. 11A and FIG. 11B, in addition to the modes illustrated in FIG. 7B and FIG. 8A. In each Figure, the traveling direction of toner bands is the X-coordinate or arrow A direction, the width direction of blade BL is the Y-coordinate direction, and the height (thickness) direction of toner bands is the Z-coordinate direction.

Figure 8B:
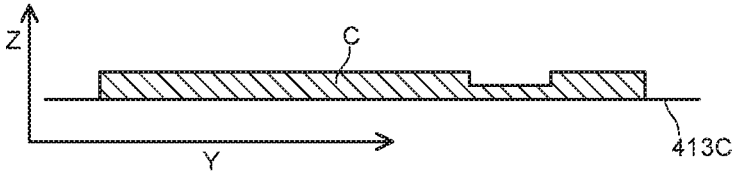
Figure 8C:
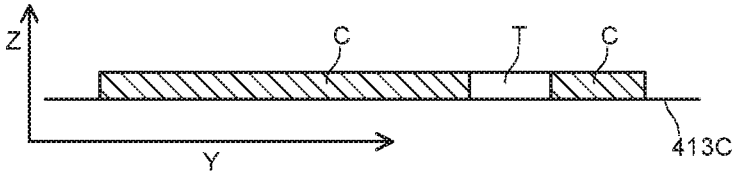
Figure 9A:
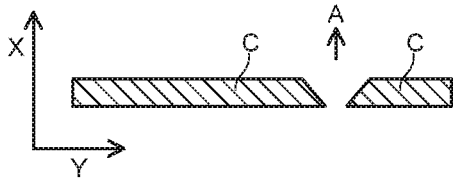
FIG. 9A to FIG. 9E are top views of toner bands supplied after detection of slippage, and illustrate modes in which the amount of toner supplied to a slippage site is increased from the downstream side to the upstream side in the traveling direction of toner.
Figure 9B:
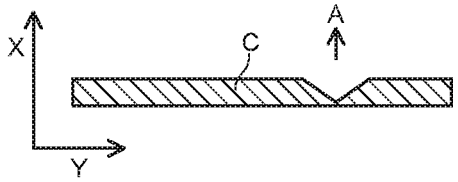
Figure 9C:
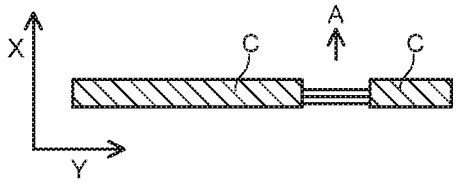
Figure 9D:
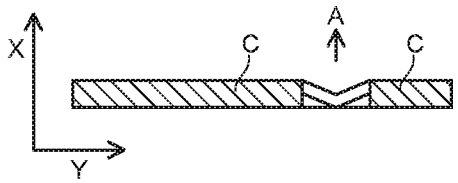
Figure 9E:
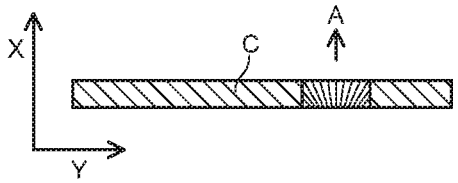
Figure 9F:
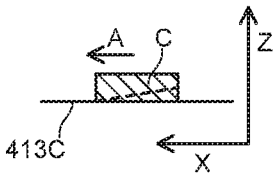
FIG. 9F corresponds to FIG. 9E and is a side view of the toner band supplied after detection of slippage.

Such a toner band can be in a mode in which the mount of toner supplied only to the slippage portion is reduced (see FIG. 8B). Alternatively, a mode (not shown) in which the amount of toner supplied only to the slippage portion is increased is also possible in order to overcome the above-mentioned stiffness, for example. In this case, the toner band is preferably formed of transparent toner (T). Such a toner band may be in a mode in which transparent toner (T) is supplied only to the slippage portion in order to impart lubricity to the slippage portion without causing toner stains in the case of another slipping of toner (see FIG. 8C).

Also, as illustrated in FIG. 9A to FIG. 9F, such a toner band may be in a mode in which the amount of toner supplied to the slippage portion is increased from the downstream side to the upstream side in the traveling direction of toner, and thus strain on the slippage portion due to supplying of toner may be gradually increased. In other words, such a toner band may be in a mode in which the shape of toner in a portion corresponding to the slippage portion is tapered in a planar view and no toner is supplied to the center in the width direction (see FIG. 9A), or a minimum amount of toner is supplied to the central part in the width direction (see FIG. 9B). Alternatively, such a toner band may be in a mode in which the shape of toner in a portion corresponding to the slippage portion is composed of a plurality of narrow straight lines (see FIG. 9C) or in a mode in which the shape of toner is composed of a plurality of lines bent on the upstream side in the traveling direction of toner (see FIG. 9D). Alternatively, such a toner band may be in a mode in which the amount of toner supplied to a portion corresponding to the slippage portion is gradually increased from the downstream side to the upstream side in the traveling direction of toner (see FIG. 9E and FIG. 9F).

Figure 10A:
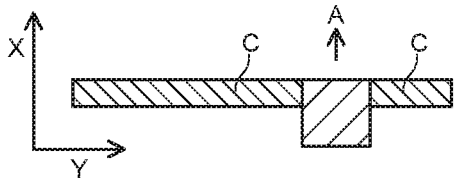
FIG. 10A to FIG. 10C are top views of various modes of toner bands supplied after detection of slippage.
Figure 10B:
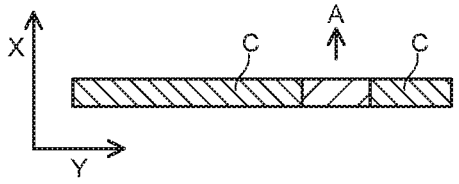
Figure 10C:
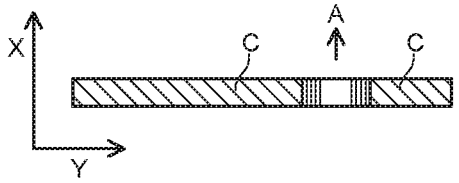

Moreover, as illustrated in FIG. 10A and FIG. 10B, such a toner band may be in a mode in which toner is variably extended on the upstream side in the traveling direction of toner while the amount of toner supplied only to a portion corresponding to the slippage portion is reduced. Alternatively, such a toner band may be in a mode in which the amount of toner in the center in the width direction of a portion corresponding to the slippage portion is reduced while the amount of toner in both the end sides is increased relative to the rest portion (see FIG. 10C).

Figure 11A:
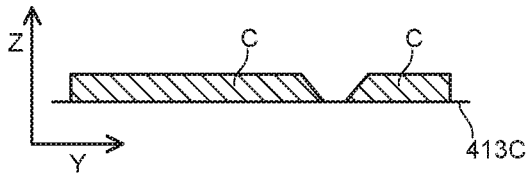
FIG. 11A and FIG. 11B illustrate, in views from the traveling direction of toner, various modes of toner bands supplied after detection of slippage.
Figure 11B:
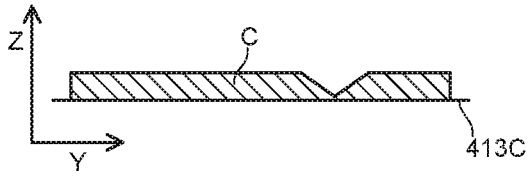

Alternatively, such a toner band may be in a mode in which the shape of toner in a portion corresponding to the slippage portion is tapered in a frontal view and no toner is supplied to the center in the width direction (see FIG. 11A) or a minimum amount of toner is supplied to the center in the width direction (see FIG. 11B).

Such a toner band may have the above-described shape of high-strain toner patterns or the same shape as those illustrated in connection with FIG. 8A to FIG. 11B, and solely consist of transparent (T) toner.

Meanwhile, when blade BL that has caused slippage is cleaning blade 427 or 425, toner patterns of any shape illustrated in connection with FIG. 8A to FIG. 11B, for example, are developed on each photoconductor drum 413T, 413Y, 413M, 413C, or 413K and supplied to the corresponding blade BL. Alternatively, toner patterns of any shape described above may be developed on one or more photoconductor drums 413T, 413Y, 413M, 413C, and 413K, and supplied to the corresponding blade(s) BL.

When blade BL that has caused slippage is cleaning blade 427 or 425, toner bands may be formed by combining shapes described in connection with FIG. 8A to FIG. 11B, for example, such that the shapes of respective colors (TYMCK) are different, and supplied to the corresponding blade BL. In this case, control section 100 develops a pattern shape of each color (TYMCK) on each photoconductor drum 413T, 413Y, 413M, 413C, or 413K during running of intermediate transfer belt 421 while being pressed against secondary transfer roller 424, and supplies the pattern shape to blade 427 or 425 by appropriately releasing firm pressing of intermediate transfer belt 421 against secondary transfer roller 424.

In addition, toner patterns or toner bands to be supplied to blade BL that has caused slippage can be formed in other various manners.

Figure 12:
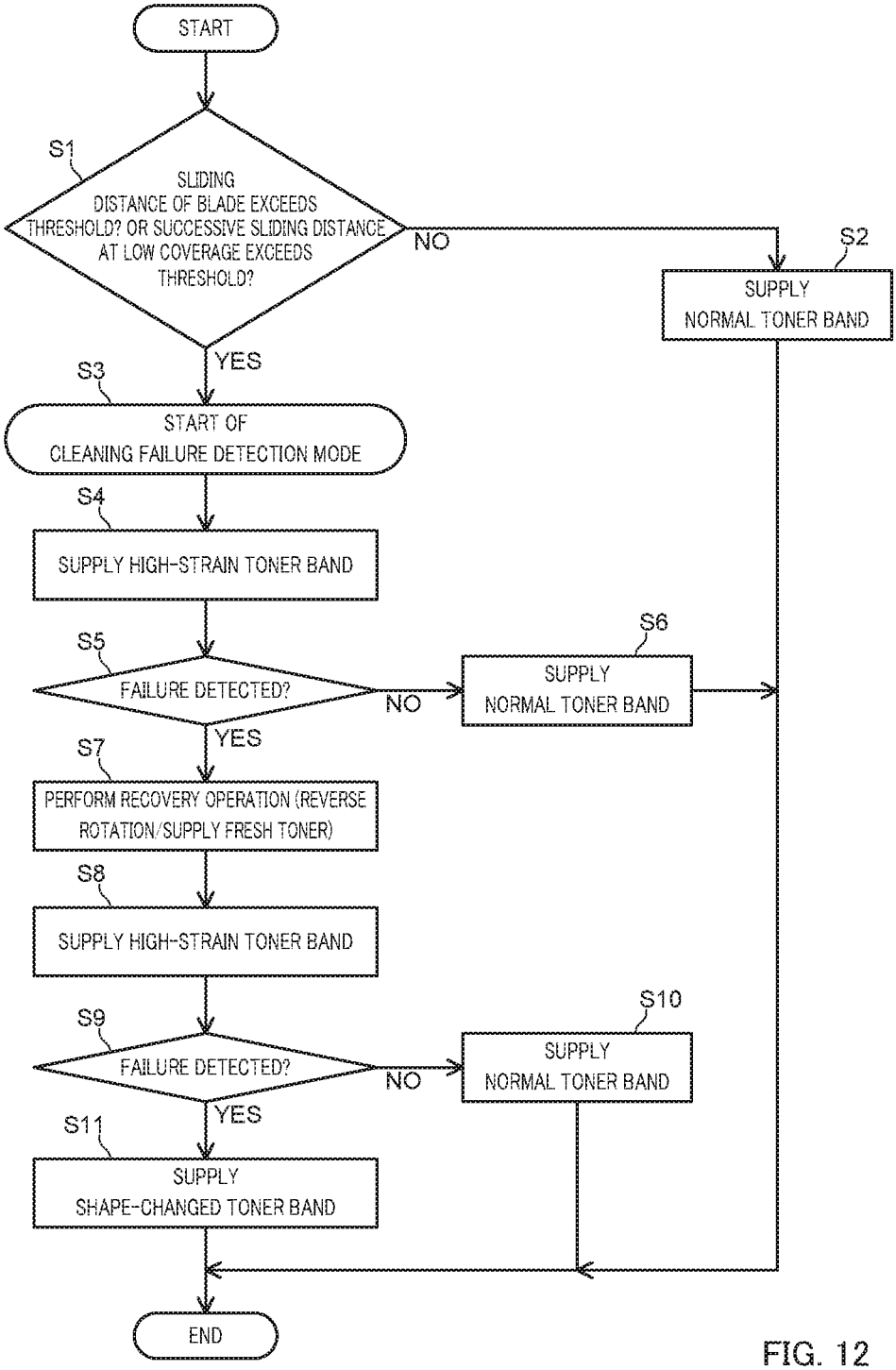
FIG. 12 is flow chart showing a process pertaining to a cleaning failure detection mode of the embodiment.

In the following, the process pertaining to a cleaning failure detection mode will be described with reference to the flow chart of FIG. 12. In the example shown in FIG. 12, control section 100 determines whether to perform control by the cleaning failure detection mode or not when the above-described normal toner bands $TB_n$ are supplied to each blade BL.

In step S1, control section 100 determines whether to perform control by the cleaning failure detection mode on the basis of the above-mentioned sliding distance information and coverage information. Specifically, control section 100 determines whether the sliding distance of any blade BL exceeds a predetermined threshold, or whether the successive sliding distance of blade BL in an image forming operation at a low coverage (coverage of 3% or lower) exceeds a predetermined threshold.

If the sliding distances of all the blades BL do not exceed a predetermined threshold and the successive sliding distance at a coverage of 3% or lower does not exceed a predetermined threshold (NO in step S1), control section 100 moves to step S2. Meanwhile, if the sliding distance of any of the blades BL exceeds a predetermined threshold or the successive sliding distance at a coverage of 3% or lower exceeds a predetermined threshold (YES in step S1), control section 100 moves to step S3.

In step S2, control section 100 assumes that no defect arises in all the blades BL (416, 427, 425), performs control for supplying the above-mentioned normal toner bands $TB_n$, and terminates the process.

In step S3, control section 100 assumes that any of the cleaning blades (416, 427, 425) is likely to be abnormal (cause a defect), and moves to the cleaning failure detection mode.

In step S4, control section 100 controls image forming section 40 such that the above-described high-strain toner patterns and high-strain toner bands $TB_S$ are formed on photoconductor drums 413, intermediate transfer belt 421, and secondary transfer roller 424. Through such control, the high-strain toner patterns (T, Y, M, C, K) and high-strain toner bands $TB_S$ are cleaned off by blades BL (416T, 416Y, 416M, 416C, 416K, 427, 425). After the end of the cleaning, control section 100 controls each section such that sheet S is fed, residual toner is transferred to sheet S, and both sides of sheet S are scanned by image detection section 80 after a fixing process is performed by fixing section 60.

In step S5, control section 100 determines whether failure in any of the blades BL is detected or not, based on output signals from image detection section 80. Specifically, in step S5, control section 100 determines that no failure is detected (all the blades BL are normal) if no toner streak (slipped toner) is detected by image detection section 80 (NO in step S5).

Meanwhile, if a toner streak is detected by image detection section 80, control section 100 determines that failure is detected (YES in step S5) and identifies a blade that has caused slippage, based on a color (single color or mixed color) of the detected toner and a side (front or rear) of sheet S. Further, control section 100 identifies a defective site in the blade that has caused slippage (position in the blade width direction), based on the position of the detected toner streak on the sheet. Accordingly, control section 100 can determine whether slipping of toner occurs or not, as well as identify a defective site, based on detected signals by image detection section 80 for every blade BL (416T, 416Y, 416M, 416C, 416K, 427, 425).

Control section 100 performs control such that the above-described normal toner patterns or normal toner bands $TB_n$ are supplied to normal blades BL that has not caused slipping of toner (NO in step S5, step 6), and excludes the normal blades BL from the subject of the cleaning failure detection mode. When no slipping of toner has occurred in all the blades BL, the process is terminated after step S6.

Meanwhile, when control section 100 determines that slipping of toner has occurred in any of the blades BL (YES in step S5), control section 100 assumes that cleaning failure arises in the corresponding blade BL and executes an operation for resolving the failure. In this example, control section 100 assumes that temporarily failed states arise in the blade BL and in the corresponding image bearing member in step S5, and moves to step S7.

In step S7, control section 100 performs control such that the blade BL and the corresponding image bearing member recover to the normal states. As this control, control section 100 controls each section such that the rotation of the image bearing member (photoconductor drum 413, intermediate transfer belt 421, or secondary transfer roller 424) that the blade BL is in contact with is reversed (perform a reverse-rotation operation). Such control is effective when an extraneous material is held between blade BL and the corresponding image bearing member. Alternatively or additionally to such control, control section 100 may perform control for supplying fresh toner to the blade BL. Alternatively, as described in connection with FIG. 8A to FIG. 8C, control section 100 may perform a process of supplying toner patterns or toner bands in a mode in which the amount of toner supplied only to the slippage portion is increased. Such control is effective when frictional force between the blade BL and the corresponding image bearing member increases, thereby causing stiffening of the blade BL.

In step S8, control section 100 controls image forming section 40 such that high-strain toner patterns or high-strain toner bands $TB_S$ are supplied again to the blade BL that is the subject of the recovery operation (failure-resolving operation) in step S7. Through such control, the above-described high-strain toner patterns or high-strain toner bands $TB_S$ are cleaned off by the blade BL. After the end of such cleaning, control section 100 controls each section such that sheet S is fed, residual toner is transferred to sheet S, and both sides of sheet S are scanned by image detection section 80 after a fixing process is performed by fixing section 60.

In step S9, whether failure is detected in the blade BL or not, i.e., whether slipping of toner still occurs in the blade BL that is the subject of the recovery operation in step S7 is determined on the basis of output signals from image detection section 80.

If control section 100 determines that no slipping of toner has occurred (NO in step S9), control section 100 assumes that the blade BL has recovered from the temporarily failed state to the normal state, performs control for supplying the above-described normal toner patterns or normal toner bands $TB_S$ (step S10), and terminates the process.

Meanwhile, if control section 100 determines that slipping of toner still occurs (YES in step S9), control section 100 identifies a defective site of the blade BL on the basis of output signals from image detection section 80, assumes that the blade BL has been abraded, and moves to step S11.

In step S11, as described in connection with FIG. 8A to FIG. 11B, for example, control section 100 controls image forming section 40 such that the shape of a toner band to be supplied to the defective site in the blade BL is changed, and then the toner band is supplied to the blade BL. When the blade BL that has caused slippage is cleaning blade 427 or 425, control section 100 may generate toner bands by combining different shapes described in connection with FIG. 8A to FIG. 11B for respective colors, corresponding to the recovery operation details (reverse-rotation driving of image bearing member or supplying of fresh toner, for example) in step S7 above, and supply the toner bands to the blade BL.

Moreover, control section 100 may control display section 21 such that a message prompting replacement of the blade BL is displayed, depending on detected results, such as detected width and concentration of slipped toner, by image detection section 80 in step S9. Alternatively, control section 100 may control display section 21 such that an indication for replacement of the blade BL is displayed. In this case, control section 100 does not need to cancel a print job. Control section 100 may perform control such that only maintenance personnel is notified of the above message prompting replacement of the blade BL and/or information indicating replacement of the blade BL through communication section 71 without displaying in display section 21.

As described in detail above, according to the embodiment, by identifying in advance a blade BL portion with a high risk of the occurrence of slipping of toner images (based on input image information), an operation for preventing the occurrence of image defects and achieving long-term use of blade BL can be executed.

In the above embodiment, control section 100 performs control such that high-strain toner patterns or high-strain toner bands $TB_S$ with a larger amount of toner per unit area than normal toner patterns or normal toner bands $TB_n$ are supplied in order to cause a blade contact portion to become a state in which slipping of toner (cleaning failure) readily occurs in the cleaning failure detection mode (step S4 and step S8). As another example, control section 100 may alternatively or additionally perform control such that a contact pressure of each cleaning blade 416 (416T, 416Y, 416M, 416C, 416K), 427, or 425 is lowered in order to cause a blade contact portion to become a state in which slipping of toner readily occurs in the cleaning failure detection mode (step S4 and step S8).

In the above embodiment, image detection section 80 (detection section) that detects slipped toner, which is originated from toner patterns for cleaning blade inspection, is disposed on the downstream side of fixing section 60 in the sheet conveying direction and is configured to scan sheet S that has processed for fixing. As another configuration, a plurality of such detection sections may also be provided so as to read, before fixing, toner patterns for cleaning blade inspection (see FIG. 7A). In this case, the detection sections are each disposed on the downstream side of cleaning blades 416, 427, and 425.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image bearing member to which a toner is supplied;

a cleaning blade that removes the toner supplied onto the image bearing member;

a hardware processor that performs control such that a tonner pattern for cleaning blade inspection is formed on the image bearing member; and a detector for detecting a toner that has slipped through the cleaning blade after the toner pattern has been allowed to reach the cleaning blade, wherein;

the hardware processor performs control such that a contact portion of the cleaning blade with the image bearing member becomes a state in which slipping of a toner readily occurs, and the hardware processor identifies a defective site in the contact portion on the basis of a detected result by the detector.

2. The image forming apparatus according to claim 1, wherein the hardware processor performs control such that the toner pattern in which a supply mode of the toner to the defective site is changed from a supply mode before the defective site has been identified is supplied to the cleaning blade in which the defective site has been identified.

3. The image forming apparatus according to claim 2, wherein the hardware processor performs control such that the toner pattern at least one of whose shape, amount, and type has been changed corresponding to the defective site is supplied to the image bearing member with which the cleaning blade is in contact.

4. The image forming apparatus according to claim 1, wherein when the toner that has slipped is detected by the detector, the hardware processor assumes that cleaning failure arises, executes an operation for resolving the failure, and performs control such that the toner pattern for cleaning blade inspection is supplied again.

5. The image forming apparatus according to claim 4, wherein the hardware processor executes an operation for reversing the rotation of the image bearing member as the operation for resolving the failure.

6. The image forming apparatus according to claim 4, wherein the hardware processor executes an operation for supplying a fresh toner to the image bearing member as the operation for resolving the failure.

7. The image forming apparatus according to claim 1, wherein;

a plurality of the image bearing members and a plurality of the cleaning blades are provided, and the hardware processor identifies at least one of the cleaning blades that has the defective site, according to the detected result by the detector.

8. The image forming apparatus according to claim 1, wherein the detector is an image reader disposed on the downstream side of a fixing section in a sheet conveying direction.

9. The image forming apparatus according to claim 1, wherein the hardware processor displays, in a display section, an indication that prompts replacement of the cleaning blade on the basis of the detected result by the detector.

10. The image forming apparatus according to claim 7, wherein the hardware processor performs control such that a toner pattern in a smaller amount than the toner pattern for cleaning blade inspection is supplied to at least one of the cleaning blades in which no defective site has been identified.

11. The image forming apparatus according to claim 1, wherein the hardware processor performs control such that the toner pattern for cleaning blade inspection is formed on the image bearing member on the basis of sliding distance information of the cleaning blade.

12. The image forming apparatus according to claim 1, wherein the hardware processor performs control such that the toner pattern for cleaning blade inspection is formed on the image bearing member on the basis of coverage information.

13. The image forming apparatus according to claim 1, wherein the hardware processor performs control such that a contact pressure of the cleaning blade against the image bearing member is lowered in order to cause the contact portion of the cleaning blade to become the state in which slipping of a toner readily occurs.

14. An inspection method for a cleaning blade of an image forming apparatus that includes an image bearing member to which a toner is supplied and a cleaning blade which removes the toner supplied onto the image bearing member, and that executes a process of supplying a toner pattern for cleaning blade inspection to the image bearing member, the inspection method comprising:

causing a contact portion of the cleaning blade with the image bearing member to become a state in which slipping of a toner readily occurs;

detecting a slipped toner after the toner pattern has been allowed to reach the cleaning blade; and identifying a defective site in the contact portion on the basis of a detected result.

* * * * *